US008900381B2

(12) United States Patent
Sugimura et al.

(10) Patent No.: US 8,900,381 B2
(45) Date of Patent: Dec. 2, 2014

(54) SPRING STEEL AND SPRING SUPERIOR IN FATIGUE PROPERTIES

(75) Inventors: Tomoko Sugimura, Kobe (JP); Koichi Sakamoto, Kobe (JP); Atsuhiko Yoshida, Kobe (JP); Kei Masumoto, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 734 days.

(21) Appl. No.: 12/241,593

(22) Filed: Sep. 30, 2008

(65) Prior Publication Data

US 2009/0126834 A1 May 21, 2009

(30) Foreign Application Priority Data

| | | |
|---|---|---|
| Nov. 19, 2007 | (JP) | 2007-299535 |
| Nov. 19, 2007 | (JP) | 2007-299536 |
| Jun. 18, 2008 | (JP) | 2008-159216 |
| Jun. 18, 2008 | (JP) | 2008-159217 |
| Jul. 31, 2008 | (JP) | 2008-198376 |
| Jul. 31, 2008 | (JP) | 2008-198377 |

(51) Int. Cl.

| | |
|---|---|
| ***C22C 38/00*** | (2006.01) |
| ***C22C 5/02*** | (2006.01) |
| ***C22C 38/04*** | (2006.01) |
| ***C21D 9/02*** | (2006.01) |
| ***C22C 38/02*** | (2006.01) |
| ***C22C 38/06*** | (2006.01) |
| *C21D 9/00* | (2006.01) |

(52) U.S. Cl.

CPC . *C22C 38/04* (2013.01); *C21D 9/02* (2013.01); *C22C 38/002* (2013.01); *C22C 38/02* (2013.01); *C22C 38/06* (2013.01); *C21D 9/0075* (2013.01); *C21D 2211/004* (2013.01)

USPC ..... 148/328; 148/405; 148/320

(58) Field of Classification Search

None

See application file for complete search history.

(56) References Cited

U.S. PATENT DOCUMENTS

| | | | |
|---|---|---|---|
| 2006/0108027 | A1 | 5/2006 | Sugimura et al. |
| 2006/0156864 | A1 | 7/2006 | Sakamoto et al. |
| 2006/0289402 | A1 | 12/2006 | Kimura et al. |
| 2007/0051432 | A1 | 3/2007 | Kimura et al. |

FOREIGN PATENT DOCUMENTS

| | | | | |
|---|---|---|---|---|
| EP | 1662016 | * | 11/2005 | ..... C22C 38/00 |
| EP | 1 662 016 | A1 | 5/2006 | |
| JP | 63-140068 | | 6/1988 | |
| JP | 5-320827 | | 12/1993 | |
| JP | 6-74484 | | 9/1994 | |
| JP | 6-74485 | | 9/1994 | |
| JP | 2005-29888 | | 2/2005 | |
| JP | 2006-144105 | | 6/2006 | |
| JP | 2007-169769 | | 7/2007 | |
| WO | WO 2005/071120 | A1 | 8/2005 | |
| WO | WO 2007/114100 | A1 | 10/2007 | |

OTHER PUBLICATIONS

Tsuyoshi Mimura, "Control Inclusions in Tire Cord Steel and Valve Spring Steel" The Iron and Steel Institute of Japan, Nishiyama Memorial Technical Lecture, Oct. 22, 2004 (the 182$^{nd}$, Tokyo). Nov. 12, 2004 (the 183$^{rd}$, Kobe), 6 pages.

Notification of Reasons(s) for Refusal issued on Mar. 19, 2013 in the corresponding Japanese Patent Application No.: 2008-198376 (with English Translation).

Japanese Notification of Reason(s) for Refusal issued Feb. 5, 2013, in Japan Patent Application No. 2008-198377 (with English translation).

* cited by examiner

*Primary Examiner* — Yoshitoshi Takeuchi

(74) *Attorney, Agent, or Firm* — Oblon, Spivak, McClelland, Maier & Neustadt, L.L.P.

(57) ABSTRACT

Disclosed is a spring steel which contains, by mass, 1.2% or less C; 0.1% to 2% Mn; 0.2% to 3% Si; 0.0003% to 0.005% Al; to 8 ppm Li; 30 ppm or less (excluding 0 ppm) Ca; and 10 ppm or less (excluding 0 ppm) Mg. The steel contains oxide inclusions satisfying the following conditions (1) to (3) in a number of $1\times10^{-4}$ or more per square millimeter: (1) containing a total of 80 percent by mass or more of $Al_2O_3$ and $SiO_2$ based on the inclusion composition excluding $Li_2O$; (2) having a ratio by mass of $Al_2O_3$ to $SiO_2$ of from 1:4 to 2:3; and (3) containing lithium (Li). The spring steel gives a spring that exhibits superior fatigue properties without strict control of the average composition of inclusions.

8 Claims, 2 Drawing Sheets

SPRING STEEL AND SPRING SUPERIOR IN FATIGUE PROPERTIES

BACKGROUND OF THE INVENTION

1. Field of the Invention

The present invention relates to spring steels superior in fatigue properties, and springs obtained from the steels. The spring steels, if formed typically into high-strength springs, exhibit high fatigue properties and are useful as materials typically for valve springs in automobile engines, as well as clutch springs, brake springs, and suspension springs.

2. Description of the Related Art

With increasing demands on lighter weighs and higher outputs of automobiles, springs such as valve springs and suspension springs used typically in engines and suspensions are designed to be resistant to higher stress. These springs should therefore be superior in fatigue resistance and setting resistance so as to endure higher load stress. Among them, strong demands are made on valve springs to have higher fatigue strength, and such demands are not satisfied even by SWOSC-V (according to Japanese Industrial Standards (JIS) G3566) steel which has been believed to be superior in fatigue strength among known steels.

Spring steels need high fatigue strength, and thereby hard nonmetallic inclusions in the steels should be minimized. From this viewpoint, high-cleanliness steels that are minimized in the nonmetallic inclusions have been generally used for such applications. With increasing strength of material steels, risks of a break (disconnection) and fatigue fractures due to nonmetallic inclusions increase. Accordingly, nonmetallic inclusions mainly causing these defects should be more and more reduced in content and size.

A variety of techniques have been proposed for the reduction of hard nonmetallic inclusions in content and size in the steels. Typically, "182nd and 183rd Nishiyama Memorial Seminar", The Iron and Steel Institute of Japan, pp. 131-134 (Reference 1) mentions that inclusions are finely divided upon rolling by maintaining the inclusions in a vitreous phase and that inclusions exist in a vitreous and stable composition in a system of $CaO—Al_2O_3—SiO_2$. Japanese Unexamined Patent Application Publication (JP-A) No. Hei 05-320827, for example, mentions that it is effective to lower the melting points of inclusions so as to enhance deposition of the vitreous portion.

JP-A No. Sho 63-140068 mentions that a spring steel superior in fatigue properties is obtained by controlling the contents of Ca and Mg, and the total content of La and Ce within suitable ranges, controlling the chemical composition of the steel adequately, and adjusting the component ratios (component ratios of $SiO_2$, MnO, $Al_2O_3$, MgO, and CaO) in the average composition of nonmetallic inclusions in the steel.

Japanese Examined Patent Application Publication (JP-B) No. Hei 06-74484 and JP-B No. Hei 06-74485 disclose such nonmetallic inclusion compositions as to make nonmetallic inclusions be liable to be drawn or destroyed upon cold working and be so soft as to cause substantially no fracture.

JP-A No. 2005-29888 proposes a technique of yielding a steel wire superior in fatigue strength, in which lithium (Li) is incorporated into the steel wire, thus inclusions have lower melting points and are enhanced to deform upon hot rolling.

These techniques indicate directions for improving characteristic properties such as fatigue properties. However, steels are not always maintained in a complete vitreous state and give crystals at temperatures for durations as employed in hot working, when the steels are controlled to have the compositions shown typically in Non-patent Document 1. Additionally, deposition of vitreous portions should be more and more enhanced so as to satisfy recent needs upon higher fatigue strength of steels.

Strict control of the average composition of inclusions is employed in most of the proposed techniques and exhibits some advantageous effects from the viewpoint of improving characteristic properties, such as fatigue properties, of spring steels. However, even according to these techniques, there may occur hard crystals such as high-$SiO_2$ crystals and anorthite ($CaO—Al_2O_3$-$2SiO_2$ oxide inclusions), and these cause fracture of the steel and adversely affect the fatigue properties thereof.

SUMMARY OF THE INVENTION

Under these circumstances, an object of the present invention is to provide a spring steel that gives, for example, a spring exhibiting superior fatigue properties even without strictly controlling the average composition of inclusions and to provide a spring that is obtained from the spring steel and superior in fatigue properties.

According to an embodiment of the present invention, there is provided a spring steel which contains, by mass, 1.2% or less carbon (C); 0.1% to 2% manganese (Mn); 0.2% to 3% silicon (Si); 0.0003% to 0.005% aluminum (Al); 0.03 to 8 ppm lithium (Li); 30 ppm or less (excluding 0 ppm) calcium (Ca); and 10 ppm or less (excluding 0 ppm) magnesium (Mg), in which the steel contains oxide inclusions satisfying the following conditions (1) to (3) in a number of $1\times10^{-4}$ or more per square millimeter:

(1) the oxide inclusions each contain a total of 80 percent by mass or more of $Al_2O_3$ and $SiO_2$ based on the inclusion composition excluding $Li_2O$;

(2) the oxide inclusions each have a ratio by mass of $Al_2O_3$ to $SiO_2$ of from 1:4 to 2:3; and (3) the oxide inclusions each contain lithium (Li).

The spring steel may further contain magnesium-containing oxide inclusions satisfying the following conditions (4) to (6) in a number of $1\times10^{-4}$ or more per square millimeter:

(4) the magnesium-containing oxide inclusions each contain a total of 80 percent by mass or more of MgO and $SiO_2$ based on the magnesium-containing oxide inclusion composition;

(5) the magnesium-containing oxide inclusions each have an MgO content (percent by mass) larger than an $SiO_2$ content (percent by mass); and (6) the magnesium-containing oxide inclusions each have an $SiO_2$ content of more than 25 percent by mass.

The spring steel is not particularly limited upon its chemical composition, except for the above basic components for use as high-strength springs, but it may further contain, if necessary, one or more elements selected from the group consisting of Cr, Ni, V, Nb, Mo, W, Cu, Ti, Co, B, and rare-earth elements (REMs). Preferred contents of these elements, if contained, vary from element to element but may be 3% or less (preferably 0.5% or more) for Cr, 0.5% or less for Ni, 0.5% or less for V, 0.1% or less for Nb, 0.5% or less for Mo, 0.5% or less for W, 0.1% or less for Cu, 0.1% or less for Ti, 0.5% or less for Co, and 0.01% or less (preferably 0.001% or more) for B. The spring steel may contain about 0.05% or less one or more rare-earth elements as elements that help to reduce the viscosity of inclusions and to exhibit more advantageous effects.

The remainder other than these components is basically iron and inevitable impurities such as sulfur (S) and phosphorus (P). The spring steel may further contain other components that do not significantly affect inclusions, such as lead (Pb) and bismuth (Bi), so as to improve the characteristic properties of the steel. Even in this case, the spring steel exhibits its advantageous effects.

The spring steel may be formed into a spring to give a spring superior in fatigue properties.

BRIEF DESCRIPTION OF THE DRAWINGS

Embodiment(s) of the present invention will be described in detail based on the following figures, wherein.

DESCRIPTION OF THE PREFERRED EMBODIMENTS

Figure 1:
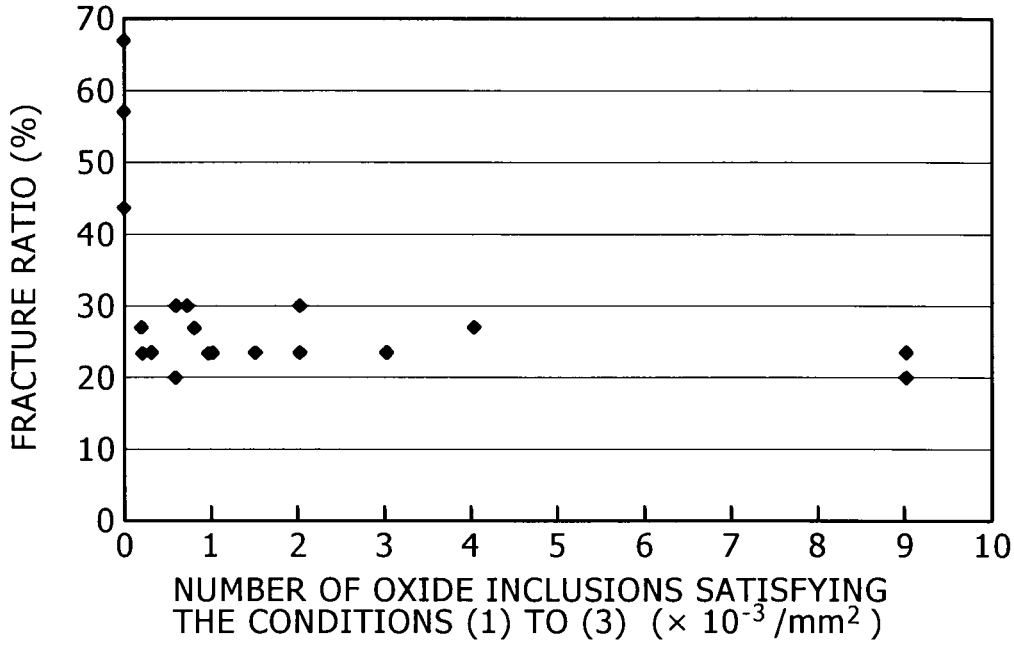
FIG. 1 is a graph showing how the fracture ratio varies depending on the number of oxide inclusions that satisfy the conditions (1) to (3), as plotted based on data in Experimental Example 1.

The present inventors made intensive investigations to provide a spring steel that exhibits superior fatigue properties without strict control of the average composition of inclusions. As a result, they found that a spring steel can have improved fatigue properties without suffering from hard crystals when it contains a specific amount of oxide inclusions satisfying specific conditions, or, where necessary, it further contains, in addition to the oxide inclusions, a specific amount of magnesium-containing oxide inclusions satisfying specific conditions. The present invention has been made based on these findings.

Oxide inclusions to be controlled herein are those satisfying the conditions (1) to (3). These oxide inclusions are supposed to be $Li_2O—Al_2O_3$-$4Si_2$ (spodumen) crystals.

Specifically, spodumen is fragile and is liable to be finely divided upon hot rolling and wire drawing. Superior fatigue properties are provided by the presence of the inclusions, which are supposed to be spodumen, in a specific amount ($1\times10^{-4}$ or more per square millimeter) in a cross-section of the steel. In particular, this configuration gives good fatigue properties even in compositions of high $SiO_2$ content and/or high $Al_2O_3$ content, which compositions have been believed to often cause hard crystals.

Magnesium-containing oxide inclusions to be controlled herein are those satisfying the conditions (4) to (6). The present inventors also found that the magnesium-containing oxide inclusions satisfying the conditions (hereinafter also referred to as "$MgO—SiO_2$ inclusions") exhibit advantageous activities and effects as in the oxide inclusions which are supposed to be spodumen. Accordingly, the presence of a specific amount of such magnesium-containing oxide inclusions may be effective.

Steels (steel materials) for use herein have only to be spring steels useful as materials for springs, and their steel types are not particularly limited. Preferred contents of basic components such as C, Mn, Si, Al, and Li are as follows. All contents (percentages and parts per million (ppm)) are by mass, unless otherwise specified. All numbers are herein assumed to be modified by the term "about."

Carbon content: 1.2% or less (excluding 0%)

Carbon (C) element is necessary for ensuring a predetermined strength to give a high-strength spring. To exhibit the characteristic properties, the carbon content is preferably 0.2% or more, and more preferably 0.4% or more. However, excessive carbon may make the steel brittle and unpractical. The carbon content is therefore preferably 1.2% or less.

Manganese content: 0.1% to 2%

Manganese (Mn) element contributes to deoxidation of the steel and increases hardenability to thereby contribute to higher strength. From these viewpoints, the manganese content is preferably 0.1% or more. However, it is preferably 2% or less, because excessive manganese may adversely affect toughness and ductility.

Silicon content: 0.2% to 3%

Silicon (Si) element is important because it serves as a main deoxidizer upon steel making, contributes to higher strength of the steel, and remarkably exhibits advantageous effects to improve fatigue properties. Further, it is useful for improving softening resistance and setting resistance. To exhibit these advantageous effects, the silicon content is preferably 0.2% or more. However, excessive silicon may cause pure $SiO_2$ during solidification to invite surface decarburization and surface defects, and this may rather adversely affect the fatigue properties. The silicon content is therefore preferably 3% or less, and more preferably 2% or less.

Aluminum content: 0.0003% to 0.005%

Aluminum (Al) element is necessary for controlling inclusions, and the aluminum content is preferably 0.0003% or more. However, excessive aluminum may cause coarse $Al_2O_3$ that causes a break, and the aluminum content is preferably 0.005% or less.

Lithium content: 0.03 to 8 ppm

Lithium (Li) element is necessary for providing the inclusions satisfying the conditions (1) to (3), and the lithium content is preferably 0.03 ppm or more. However, advantageous effects are saturated at a certain lithium content or higher, and the lithium content is preferably 8 ppm or less.

Other components than the basic components include calcium (Ca), magnesium (Mg), iron, and inevitable impurities. Calcium and magnesium are incorporated when the steel is subjected to regular ladle refining or when the steel is made to be resistant to fire. These elements are not harmful for inclusions in a silicon-killed steel and are rather effective for controlling inclusions, as mentioned in the patent documents as above. Thus, calcium and magnesium may be contained in amounts of 30 ppm or less and 10 ppm or less, respectively. Phosphorus (P) element as an inevitable impurity adversely affects the toughness/ductility of the steel, and the phosphorus content is preferably controlled to be 0.03% or less, and more preferably 0.02% or less, to prevent a break in wire drawing and subsequent stranding. Sulfur (S) element as an inevitable impurity also adversely affects the toughness/ductility of the steel as with phosphorus, and is combined with manganese to form MnS, and this causes a break upon wire drawing. Thus, the upper limit of the sulfur content is preferably set at 0.03%, and more preferably 0.02%.

Spring steels according to embodiments of the present invention may further contain one or more elements selected from the group consisting of Cr, Ni, V, Nb, Mo, W, Cu, Ti, Co, B, and rare-earth elements (REMs). Preferred contents of these elements, if contained, vary from element to element but may be 3% or less (preferably 0.5% or more) for Cr, 0.5% or less for Ni, 0.5% or less for V, 0.1% or less for Nb, 0.5% or less for Mo, 0.5% or less for W, 0.1% or less for Cu, 0.1% or less for Ti, 0.5% or less for Co, 0.01% or less (preferably 0.001% or more) for B, and 0.05% or less for rare-earth elements.

The spring steels exhibit superior fatigue properties by the deposition of oxide inclusions satisfying the conditions (1) to (3) or by the deposition of, in addition to the oxide inclusions, MgO—$SiO_2$ inclusions satisfying the conditions (4) to (6). These oxide inclusions (or the oxide inclusions and MgO—$SiO_2$ inclusions) may be deposited by incorporating lithium into the steels and adding the following process to the manufacturing processes. Upon hot rolling of spring steels, blooming at 900° C. to 1300° C. and wire rod rolling at 800° C. to 1100° C. are generally conducted. However, when such hot rolling processes alone are conducted, the resulting steels become liable to cause hard crystals such as high-$SiO_2$ crystals and anorthite that are deposited at high temperatures. In contrast, the oxide inclusions satisfying the conditions (1) to (3) and the MgO—$SiO_2$ inclusions satisfying the conditions (4) to (6) are liable to deposit at relatively low temperatures. It is therefore recommended to carry out sufficient soaking at relatively low temperatures, e.g., at 500° C. to 800° C. and then carry out such regular hot working processes. The ways to fabricate the spring steels are not limited to these, and any way will do, as long as specific amounts of oxide inclusions [oxide inclusions satisfying the conditions (1) to (3)] and MgO—SiO2 inclusions [magnesium-containing oxide inclusions satisfying the conditions (4) to (6)] can deposit.

Springs superior in fatigue properties are given by adjusting the chemical compositions of the spring steels, controlling the number of the oxide inclusions satisfying the conditions (1) to (3) or the numbers of the oxide inclusions and of the MgO—$SiO_2$ inclusions satisfying the conditions (4) to (6), and forming the spring steels into springs.

EXAMPLES

The present invention will be illustrated in further detail with reference to several experimental examples below. It is to be noted that the followings are only examples and are never construed to limit the scope of the present invention, and various changes and variations are possible therein without departing from the teaching and scope of the present invention.

Experimental Example 1

An experiment using actual machines (or laboratory machines) was conducted. In the experiment using actual machines, a molten steel contained in a converter was poured into a ladle (500 kg of a steel similar to that produced by a converter was made in the laboratory), various fluxes were added to the molten steel, and the molten steel was subjected to composition adjustment, heating according to necessity, and argon bubbling, and ladle refining (slag refining). Where necessary, Ca, Mg, and/or Li were added to the molten steel. Steel wires of 8 mm in diameter were made by subjecting the ingots to blooming or forging, and hot rolling. Some samples (Samples Nos. 1 to 19) were subjected to soaking at 750° C. for 2 hours before the hot rolling.

The chemical compositions of the fabricated steel wires are shown in Table 1 below. The lithium contents of the steels were measured according to the following technique.

Lithium Content of Steel

An aliquot (0.5 g) of a test sample was sampled from the steel wire, placed in a beaker, and heated and thereby decomposed in a mixture of pure water, hydrochloric acid, and nitric acid in the beaker. The resulting mixture was left stand to cool and transferred to a 100-mL measuring flask to give a test solution. The test solution was diluted with pure water, and the lithium content was quantitatively analyzed with an inductively coupled plasma (ICP) mass spectrometer (Model SPQ 8000, Seiko Instruments Inc.).

In the case of a steel having a lithium content of 1 ppm or less, 0.5 g of a sample was sampled from the steel wire, placed in a beaker, and heated and hydrolyzed in a mixture of pure water, hydrochloric acid, and nitric acid in the beaker. The resulting mixture was combined with hydrochloric acid to adjust its acidity, further combined with methyl isobutyl ketone (MIBK), and shaken to extract iron in a MIBK phase. After leaving stand, an aqueous phase alone was retrieved and transferred to a 100-mL measuring flask to give a test solution. The test solution was diluted with pure water, and the lithium content thereof was quantitatively analyzed with an inductively coupled plasma (ICP) mass spectrometer (Model SPQ 8000, Seiko Instruments Inc.) under the above conditions.

TABLE 1

| Sample | | Chemical composition* (percent by mass; or ppm by mass for Li, Mg, and Ca) | | | | | | | |
|---|---|---|---|---|---|---|---|---|---|
| No. | Steel | C | Si | Mn | Al | Li | Mg | Ca | Other components |
| 1 | A | 0.58 | 1.5 | 0.7 | 0.0005 | 0.3 | ≤5 | ≤5 | Cr: 0.9, Ni: 0.25, V: 0.1 |
| 2 | B | 0.55 | 1.0 | 0.7 | 0.001 | 4 | ≤5 | 17 | Cr: 0.7, Ni: 0.25, V: 0.1 |
| 3 | C | 0.60 | 2.4 | 0.4 | 0.0007 | 0.1 | ≤5 | ≤5 | — |
| 4 | D | 0.50 | 1.5 | 0.7 | 0.001 | 0.3 | ≤5 | ≤5 | — |
| 5 | E | 0.50 | 2.2 | 0.7 | 0.002 | 0.8 | ≤5 | 7 | — |
| 6 | F | 0.50 | 2 | 0.5 | 0.003 | 1 | ≤5 | 8 | — |
| 7 | G | 0.60 | 2 | 0.9 | 0.0005 | 2 | ≤5 | 13 | — |
| 8 | H | 0.40 | 2.5 | 0.7 | 0.003 | 7 | 8 | 13 | — |
| 9 | I | 0.50 | 3.2 | 0.7 | 0.0013 | 3 | ≤5 | 18 | — |
| 10 | J | 0.50 | 2 | 0.4 | 0.0013 | 1 | ≤5 | 8 | — |
| 11 | K | 0.60 | 2.1 | 0.5 | 0.001 | 2 | ≤5 | 7 | Cr: 1.75, Ni: 0.2, V: 0.3 |
| 12 | L | 0.60 | 2 | 0.9 | 0.0008 | 0.5 | ≤5 | 9 | Cr: 0.9, Ni: 0.25, V: 0.1 |
| 13 | M | 0.50 | 1.5 | 0.4 | 0.001 | 5 | ≤5 | 15 | Cr: 0.7, V: 0.1 |
| 14 | N | 0.70 | 1.5 | 0.8 | 0.001 | 0.7 | ≤5 | 7 | Cr: 0.7 |
| 15 | O | 0.60 | 2.1 | 0.6 | 0.001 | 0.3 | ≤5 | ≤5 | Cr: 1.75, Ni: 0.2, V: 0.3, Ti: 0.002 |
| 16 | P | 0.50 | 2.2 | 0.7 | 0.001 | 0.03 | ≤5 | 28 | Ti: 0.01 |
| 17 | Q | 0.40 | 2.8 | 0.9 | 0.002 | 0.5 | ≤5 | ≤5 | Nb: 0.1, W: 0.05, Mo: 0.03 |
| 18 | R | 0.60 | 2.1 | 0.7 | 0.004 | 0.6 | ≤5 | ≤5 | Ce: 0.0005, B: 0.003 |
| 19 | S | 0.50 | 2.2 | 0.7 | 0.002 | 0.5 | ≤5 | 10 | Co: 0.1, Cu: 0.02 |
| 20 | T | 0.58 | 1.46 | 0.7 | 0.001 | 0.3 | ≤5 | ≤5 | Cr: 0.9, Ni: 0.25, V: 0.1 |
| 21 | U | 0.55 | 1.46 | 0.7 | 0.002 | 0.6 | ≤5 | 17 | Cr: 0.7, Ni: 0.25, V: 0.1 |

TABLE 1-continued

| Sample | | Chemical composition* (percent by mass; or ppm by mass for Li, Mg, and Ca) | | | | | | | |
|---|---|---|---|---|---|---|---|---|---|
| No. | Steel | C | Si | Mn | Al | Li | Mg | Ca | Other components |
| 22 | V | 0.60 | 2 | 0.9 | 0.0005 | 0 | ≤5 | 13 | — |
| 23 | W | 0.50 | 1.5 | 0.7 | 0.001 | 0 | ≤5 | 7 | — |
| 24 | X | 0.55 | 2.0 | 0.7 | 0.0008 | 2 | ≤5 | ≤5 | Ni: 0.2, Cr: 1 |

*Remainder: iron and inevitable impurities

Regarding phosphorus and sulfur contents of the steels in Table 1, Steel G (Sample No. 7) has a phosphorus content of 0.02% and a sulfur content of 0.003%; Steel K (Sample No. 11) has a phosphorus content of 0.01% and a sulfur content of 0.015%; Steel L (Sample No. 12) has a phosphorus content of 0.01% and a sulfur content of 0.010%; Steel V (Sample No. 22) has a phosphorus content of 0.02% and a sulfur content of 0.003%; and each of the other steels has a phosphorus content of 0.03% or less and a sulfur content of 0.03% or less.

The average composition of inclusions of the resulting steel wires was determined according to the following technique. Regarding oxide inclusions satisfying the conditions (1) to (3), all inclusion particles in an objective field (in 10000 $mm^2$ or more of a cross-section of the steel wires) were analyzed to identify oxide inclusions having such compositions as to satisfy the conditions (1) to (3), and the number of the oxide inclusions was counted. The fatigue properties of the steel wires were determined by conducting a rotary bending fatigue test simulating a valve spring according to the following technique.

Composition of Inclusions (Excluding $Li_2O$) of Steel Wire

Each of the steel wires was hot-rolled, the longitudinal cross-section (cross-section including the shaft center) of the hot-rolled steel wires was polished, the compositions of all inclusions having a short axis of 5 μm or more and appearing in the polished cross-section were determined with an electron probe microanalyzer (EPMA), the compositions were converted into those of oxides, and the average thereof was determined. The conditions for EPMA measurement are as follows:

EPMA: JXA-8621MX (NEC Corporation)

Analyzer (energy dispersive X-ray spectrometer; EDS): TN-5500 (Tracor Northern)

Accelerating voltage: 20 kV

Analyzing current: 5 nA

Analyzing technique: quantitative analysis by energy dispersion analysis (the entire particle was analyzed)

Measuring area: 10000 $mm^2$ or more

Measurement of Lithium Content of Inclusions

As the lithium content is not measurable typically by an EPMA, the lithium content was determined in the following manner. The oxide inclusions satisfying the conditions (1) to (3) were measured by Secondary Ion Mass Spectroscopy (SIMS) (primary ion species: $O_2^+$, secondary ion polarity: positive), and relative secondary ion intensities of $^7Li^+$ and $^{28}Si^+$ were determined. An inclusion having a ratio $^7Li^+/^{28}Si^+$ of 0.01 or more was evaluated as containing lithium. The measurement was conducted with a CAMECA secondary ion mass spectrometer "ims5f".

Fatigue Strength Test (Fracture Ratio)

Each of the 8.0 mm diameter steel wires formed by hot rolling was subjected sequentially to a shaving process (diameter: 7.4 mm), a patenting process, a cold drawing process (diameter: 4 mm), and an oil tempering process (continuous tempering process for oil quenching and tempering in a lead bath at about 450° C.) to give steel wires of 4.0 mm in diameter and 650 mm in length. The wires were then subjected sequentially to a stress relief annealing process (400° C.), a shot peening process, and a low-temperature annealing process at 200° C. to give test steel wires. The fatigue strength of the test steel wires was measured by a Nakamura type rotating bending fatigue tester. Fatigue test conditions were: 970 MPa in nominal stress, 4000 to 5000 rpm in rotating speed and $2\times10^7$ in the number of bending cycles. The number of the test steel wires caused to fracture by the inclusions before $2\times10^7$ bending cycles was counted and fracture ratio was calculated according to the following expression:

$$\text{(Fracture ratio) (\%)} = \left[\frac{\text{(Number of steel wires caused to fracture by inclusion before } 2\times10^7 \text{ bending cycles)}}{\left\{\begin{array}{c}\text{\{Number of steel wires caused to fracture by inclusion before } 2\times10^7 \text{ bending cycles\} +}\\ \text{(Number of steel wires not fractured after } 2\times10^7 \text{ bending cycles)}\end{array}\right\}}\right]\times100$$

The results of the tests of the steel wires with the average compositions thereof are shown in Table 2 below. The contents of elements other than lithium were measured according to the following techniques.

C: Infrared absorbing analysis after combustion

Si, Mn, Ni, Cr, V, Ti, Mg, Nb, Mo, W, Cu, and Co: Inductively coupled plasma atomic emission spectrometry Al, REMs, and B: Inductively coupled plasma mass spectrometry Ca: Flameless atomic absorption spectrometry

TABLE 2

| Sample No. | Steel | Average composition of inclusions other than $Li_2O$ (percent by mass) CaO | $Al_2O_3$ | $SiO_2$ | MgO | MnO | Number of oxide inclusions satisfying the conditions (1) to (3) ($\times 10^{-3}/mm^2$) | Fracture ratio (%) |
|---|---|---|---|---|---|---|---|---|
| 1 | A | 19 | 9 | 63 | 3 | 0 | 0.6 | 20 |
| 2 | B | 19 | 20 | 54 | 2 | 1 | 3.0 | 23 |
| 3 | C | 7 | 6 | 83 | 1 | 0 | 0.2 | 27 |
| 4 | D | 15 | 15 | 60 | 1 | 1 | 0.7 | 30 |
| 5 | E | 30 | 20 | 30 | 3 | 2 | 1.0 | 23 |
| 6 | F | 15 | 36 | 40 | 3 | 2 | 2.0 | 30 |
| 7 | G | 44 | 5 | 42 | 5 | 2 | 2.0 | 30 |
| 8 | H | 15 | 18 | 58 | 3 | 1 | 9.0 | 23 |
| 9 | I | 20 | 12 | 55 | 2 | 0 | 1.5 | 23 |
| 10 | J | 28 | 14 | 50 | 5 | 0 | 0.8 | 27 |
| 11 | K | 40 | 5 | 48 | 2 | 1 | 9.0 | 20 |
| 12 | L | 29 | 18 | 43 | 6 | 1 | 2.0 | 30 |
| 13 | M | 15 | 23 | 40 | 3 | 2 | 4.0 | 27 |
| 14 | N | 18 | 20 | 47 | 2 | 3 | 2.0 | 23 |
| 15 | O | 30 | 20 | 43 | 2 | 1 | 1.0 | 23 |
| 16 | P | 50 | 15 | 32 | 1 | 0 | 0.6 | 30 |
| 17 | Q | 30 | 30 | 35 | 2 | 0 | 0.3 | 23 |
| 18 | R | 20 | 42 | 30 | 5 | 1 | 0.2 | 23 |
| 19 | S | 30 | 20 | 30 | 3 | 1 | 1.0 | 23 |
| 20 | T | 19 | 9 | 63 | 3 | 0 | 0.05 | 43 |
| 21 | U | 19 | 20 | 54 | 2 | 1 | 0.05 | 43 |
| 22 | V | 44 | 6 | 41 | 6 | 2 | 0 | 67 |
| 23 | W | 15 | 15 | 60 | 1 | 1 | 0 | 67 |
| 24 | X | 24 | 18 | 50 | 1 | 1 | 0.02 | 57 |

These data demonstrate as follows. Samples Nos. 1 to 19 exhibit good fatigue strength, because they contain satisfactory amounts of oxide inclusions satisfying the conditions (1) to (3).

In contrast, Samples Nos. 20 to 24 show insufficient fatigue strength, because they do not contain satisfactory amounts of oxide inclusions satisfying the conditions (1) to (3).

Specifically, Samples Nos. 20, 21, and 24, although containing specific amounts of lithium as a steel component, have not undergone soaking, thereby fail to include sufficient amounts of oxide inclusions, and show high fracture ratios.

Samples Nos. 22 and 23 use steels containing no lithium, thereby fail to contain oxide inclusions satisfying the conditions (1) to (3), and show high fracture ratios.

FIG. 1 is a graph showing how the fracture ratio varies depending on the number of oxide inclusions satisfying the conditions (1) to (3), as plotted based on the data in Table 2. These results demonstrate that suitable deposition of oxide inclusions satisfying the conditions (1) to (3) improves fatigue properties of spring steels.

Experimental Example 2

An experiment using actual machines (or laboratory machines) was conducted. In the experiment using actual machines, a molten steel contained in a converter was poured into a ladle (500 kg of a steel similar to that produced by a converter was made in the laboratory), various fluxes were added to the molten steel for composition adjustment, and the molten steel was subjected to heating according to necessity, argon bubbling, and ladle refining (slag refining). Where necessary, after being adjusted in contents of other components, Ca, Mg, and/or Li were added to the molten steel and held for 5 minutes or longer. Steel wires of 8 mm in diameter were made by subjecting the steel ingots to blooming or forging, and hot rolling. Some samples (Samples Nos. 25 to 30, 32, and 33) were subjected to soaking at 750° C. for 2 hours before the hot rolling.

The chemical compositions of the fabricated steel wires are shown in Table 3 below. The lithium contents of the steels were measured by the procedure of Experimental Example 1.

TABLE 3

| Sample No. | Steel | Chemical composition* (percent by mass; or ppm by mass for Li, Mg, and Ca) C | Si | Mn | Al | Li | Mg | Ca | Other components |
|---|---|---|---|---|---|---|---|---|---|
| 25 | A1 | 0.65 | 1.4 | 0.65 | 0.0003 | 0.3 | 28 | ≤5 | — |
| 26 | B1 | 0.60 | 2.0 | 0.65 | 0.0003 | 1.0 | 10 | 7 | — |
| 27 | C1 | 0.60 | 2.2 | 0.65 | 0.0003 | 0.3 | 19 | 10 | — |
| 28 | D1 | 0.60 | 2.0 | 0.90 | 0.001 | 0.6 | ≤5 | 30 | Ni: 0.25, Cr: 0.9, V: 0.1 |
| 29 | E1 | 0.63 | 1.5 | 0.65 | 0.002 | 0.1 | ≤5 | 9 | Cr: 0.65, V: 0.09, Ti: 0.002, Nb: 0.1, W: 0.05, Mo: 0.03 |
| 30 | F1 | 0.60 | 2.1 | 0.5 | 0.002 | 2.0 | 7 | ≤5 | Ce: 0.005, Co: 0.1, Cu: 0.02, B: 0.003 |
| 31 | G1 | 0.65 | 1.4 | 0.65 | 0.0004 | 0.3 | 28 | ≤5 | Cr: 0.65, V: 0.09 |
| 32 | H1 | 0.60 | 2.0 | 0.65 | 0.0003 | 0 | 21 | 9 | — |
| 33 | I1 | 0.65 | 1.5 | 0.65 | 0.0003 | 0.3 | 7 | 11 | — |
| 34 | J1 | 0.60 | 2.0 | 0.65 | 0.0003 | 2.0 | ≤5 | 7 | — |

*Remainder: iron and inevitable impurities

The average composition of inclusions of the resulting steel wires was determined by the procedure of Experimental Example 1, except for the objective field. Regarding oxide inclusions satisfying the conditions (1) to (3), all inclusion particles in an objective field (in 10000 $mm^2$ or more of a cross-section of the steel wires) were analyzed to identify, as spodumen, oxide inclusions satisfying the conditions (1) to (3), and the number of the oxide inclusions was counted. Regarding magnesium-containing oxide inclusions satisfying the conditions (4) to (6), all inclusion particles in an objective field (in 100000 mm2 or more of a cross-section of the steel wires) were analyzed, and those having the corresponding compositions were identified as MgO—$SiO_2$ inclusions, and the number of the MgO—$SiO_2$ inclusions was counted. The fatigue properties of the steel wires were determined by conducting a rotary bending fatigue test simulating a valve spring by the procedure of Experimental Example 1.

The results of the tests of the steel wires with the average compositions thereof are shown in Table 4 below. The contents of elements other than lithium were measured by the procedure of Experimental Example 1.

TABLE 4

| Sample | | Average composition of inclusions other than $Li_2O$ (percent by mass) | | | | | Number of oxide inclusions satisfying | Number of magnesium-containing oxide inclusions satisfying the | Fracture ratio |
|---|---|---|---|---|---|---|---|---|---|
| No. | Steel | CaO | $Al_2O_3$ | $SiO_2$ | MgO | MnO | the conditions (1) to (3) ($\times 10^{-3}/mm^2$) | conditions (4) to (6) ($\times 10^{-4}/mm^2$) | (%) |
| 25 | A1 | 15 | 12 | 49 | 20 | 0 | 0.2 | 50 | 20 |
| 26 | B1 | 16 | 10 | 48 | 19 | 0 | 2.0 | 100 | 30 |
| 27 | C1 | 18 | 11 | 48 | 18 | 0 | 0.5 | 1.0 | 24 |
| 28 | D1 | 23 | 16 | 50 | 3 | 2 | 1.0 | 30 | 20 |
| 29 | E1 | 22 | 20 | 49 | 2 | 2 | 0.7 | 70 | 30 |
| 30 | F1 | 19 | 20 | 50 | 5 | 1 | 1.5 | 50 | 25 |
| 31 | G1 | 16 | 9 | 53 | 20 | 0 | 0.05 | 10 | 43 |
| 32 | H1 | 15 | 12 | 45 | 20 | 0 | 0 | 3.0 | 67 |
| 33 | I1 | 20 | 12 | 49 | 15 | 0 | 0.5 | 0.1 | 35 |
| 34 | J1 | 20 | 10 | 48 | 14 | 0 | 0.01 | 0.2 | 65 |

These data demonstrate that Samples Nos. 25 to 30 exhibit good fatigue strength, because they contain satisfactory amounts of oxide inclusions satisfying the conditions (1) to (3) and magnesium-containing oxide inclusions satisfying the conditions (4) to (6).

In contrast, Samples Nos. 31 to 34 exhibit insufficient fatigue properties in the fatigue test, because they do not contain satisfactory amounts of oxide inclusions satisfying the conditions (1) to (3) and magnesium-containing oxide inclusions satisfying the conditions (4) to (6).

Specifically, Samples Nos. 31 and 34, although containing specific amounts of lithium and magnesium as steel components, have not undergone soaking, thereby fail to contain sufficient amounts of the oxide inclusions satisfying the conditions (1) to (3), and show somewhat high fracture ratios. Sample No. 33 fails to contain sufficient amounts of the magnesium-containing oxide inclusions and thereby shows a somewhat high fracture ratio.

Sample No. 32 uses a steel containing no lithium, thereby fails to contain oxide inclusions satisfying the conditions (1) to (3), and shows a high fracture ratio.

Figure 2:
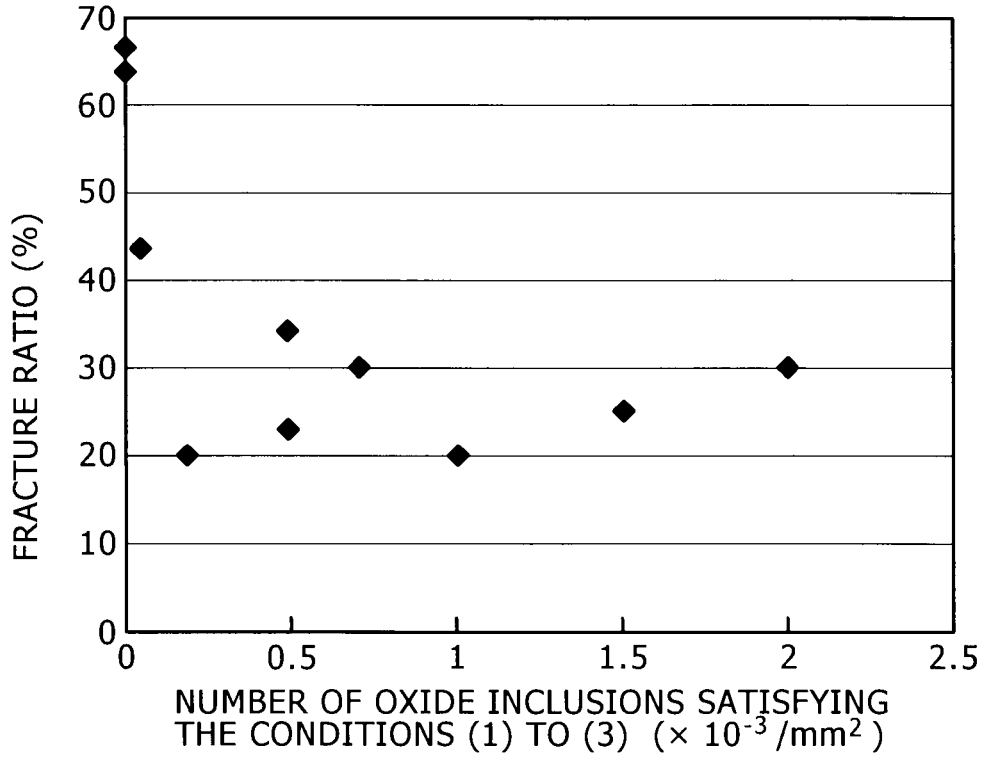
FIG. 2 is a graph showing how the fracture ratio varies depending on the number of oxide inclusions that satisfy the conditions (1) to (3), as plotted based on data in Experimental Example 2.
Figure 3:
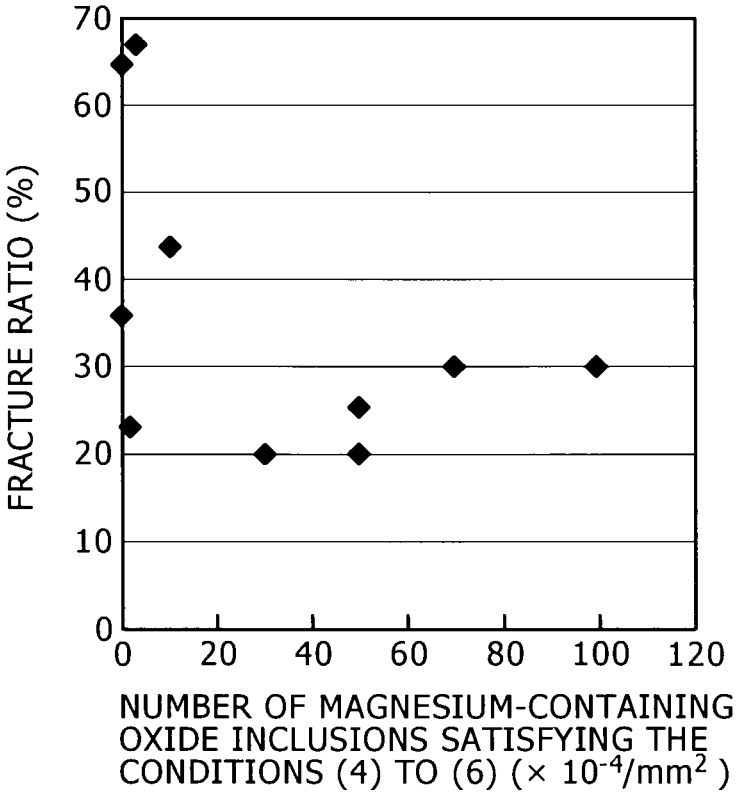
FIG. 3 is a graph showing how the fracture ratio varies depending on the number of magnesium-containing oxide inclusions ($MgO—SiO_2$ inclusions) that satisfy the conditions (4) to (6), as plotted based on data in Experimental Example 2.

FIG. 2 shows how the fracture ratio varies depending on the number of oxide inclusions satisfying the conditions (1) to (3), and FIG. 3 shows how the fracture ratio varies depending on the number of magnesium-containing oxide inclusions satisfying the conditions (4) to (6) (MgO—$SiO_2$ inclusions), as plotted based on the data in Table 4. These demonstrate that suitable deposition of the oxide inclusions satisfying the conditions (1) to (3) and the magnesium-containing oxide inclusions satisfying the conditions (4) to (6) (MgO—SiO, inclusions) improves fatigue properties of spring steels.

As has been described above, spring steels for yielding springs superior in fatigue properties are provided by specifying the number of oxide inclusions satisfying the conditions (1) to (3). Such spring steels for yielding springs superior in fatigue properties are also provided by specifying the number of magnesium-containing oxide inclusions satisfying the conditions (4) to (6), in addition to the above configuration.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A spring steel comprising, by mass, 1.2% or less carbon (C);

0.1% to 2% manganese (Mn);

0.2% to 3% silicon (Si);

0.0003% to 0.005% aluminum (Al);

0.03 to 8 ppm lithium (Li);

30 ppm or less (excluding 0 ppm) calcium (Ca); and 28 ppm or less (excluding 0 ppm) magnesium (Mg), wherein the steel contains oxide inclusions satisfying the following conditions (1) to (3) in a number of $1\times10^4$ or more per square millimeter:

(1) the oxide inclusions each contain a total of 80 percent by mass or more of $Al_2O_3$ and $SiO_2$ based on the inclusion composition excluding $Li_2O$;

(2) the oxide inclusions each have a ratio by mass of $Al_2O_3$ to $SiO_2$ of from 1:4 to 2:3; and (3) the oxide inclusions each contain lithium (Li), and wherein the oxide inclusions are $Li_2O.Al_2O_3.4SiO_2$ crystals.

2. The spring steel according to claim 1, further comprising magnesium-containing oxide inclusions satisfying the following conditions (4) to (6) in a number of $1\times10^4$ or more per square millimeter:

(4) the magnesium-containing oxide inclusions each contain a total of 80 percent by mass or more of MgO and $SiO_2$ based on the magnesium-containing oxide inclusion composition;

(5) the magnesium-containing oxide inclusions each have an MgO content (percent by mass) larger than an $SiO_2$ content (percent by mass); and (6) the magnesium-containing oxide inclusions each have an $SiO_2$ content of more than 25 percent by mass.

3. The spring steel according to claim 1, further comprising at least one element selected from the group consisting of 3% or less chromium (Cr), 0.5% or less nickel (Ni), 0.5% or less vanadium (V), 0.1% or less niobium (Nb), 0.5% or less molybdenum (Mo), 0.5% or less tungsten (W), 0.1% or less copper (Cu), 0.1% or less titanium (Ti), 0.5% or less cobalt (Co), 0.01% or less boron (B), and 0.05% or less one or more rare-earth elements.

4. The spring steel according to claim 2, further comprising at least one element selected from the group consisting of 3% or less chromium (Cr), 0.5% or less nickel (Ni), 0.5% or less vanadium (V), 0.1% or less niobium (Nb), 0.5% or less molybdenum (Mo), 0.5% or less tungsten (W), 0.1% or less copper (Cu), 0.1% or less titanium (Ti), 0.5% or less cobalt (Co), 0.01% or less boron (B), and 0.05% or less one or more rare-earth elements.

5. A spring made from the spring steel of claim 1.

6. A spring made from the spring steel of claim 2.

7. A spring made from the spring steel of claim 3.

8. A spring made from the spring steel of claim 4.

* * * * *